United States Patent [19]

Ring

[11] Patent Number: 4,518,319

[45] Date of Patent: May 21, 1985

[54] VARIABLE DISPLACEMENT PUMP SYSTEM

[75] Inventor: Curtis P. Ring, Calgary, Canada

[73] Assignee: Deere & Company, Moline, Ill.

[21] Appl. No.: 576,686

[22] Filed: Feb. 3, 1984

[51] Int. Cl.[3] ..... F04B 1/26

[52] U.S. Cl. ..... 417/217; 60/389; 60/392; 60/443; 60/452; 137/596.13; 417/218; 417/222

[58] Field of Search ..... 60/443, 444, 452, 445, 60/389, 391, 392; 417/217, 218–222; 137/596.13, 596.12; 91/374

[56] References Cited

U.S. PATENT DOCUMENTS

| | | | |
|---|---|---|---|
| 3,164,960 | 1/1965 | Weisenbach et al. . | |
| 3,191,382 | 6/1965 | Weisenbach | 60/389 |
| 3,350,881 | 11/1967 | D'Amato . | |
| 3,416,452 | 12/1968 | Misulis . | |
| 3,635,021 | 1/1972 | McMillen et al. . | |
| 3,669,570 | 6/1972 | Himmler | 417/222 |
| 3,694,108 | 9/1972 | Pensa . | |
| 3,746,115 | 7/1973 | Bosch | 60/443 X |
| 3,758,235 | 9/1973 | Breeden | 417/222 |
| 3,941,514 | 3/1976 | Louis et al. . | |
| 4,212,164 | 7/1980 | Young | 60/452 |
| 4,456,434 | 6/1984 | El Ibiary | 60/389 X |

OTHER PUBLICATIONS

Abex Corp., Hydrostatic Transmission Manual, Chap. 2, "Gold Cup Circuitry", pp. 2.1 and 2.3, Apr. 1980.

*Primary Examiner*—Edward K. Look

[57] ABSTRACT

A variable displacement pump has a swashplate controlled by a pair of pistons. A shuttle valve communicates the highest pressure pump workport to an operator-controlled displacement control valve. A pressure-responsive override valve is connected in series between the displacement control valve and the pistons. When an override pressure is achieved, the override valve blocks communication of the control valve with the pair of pistons and communicates the pump workports directly to the pistons for rapid destroking.

7 Claims, 1 Drawing Figure

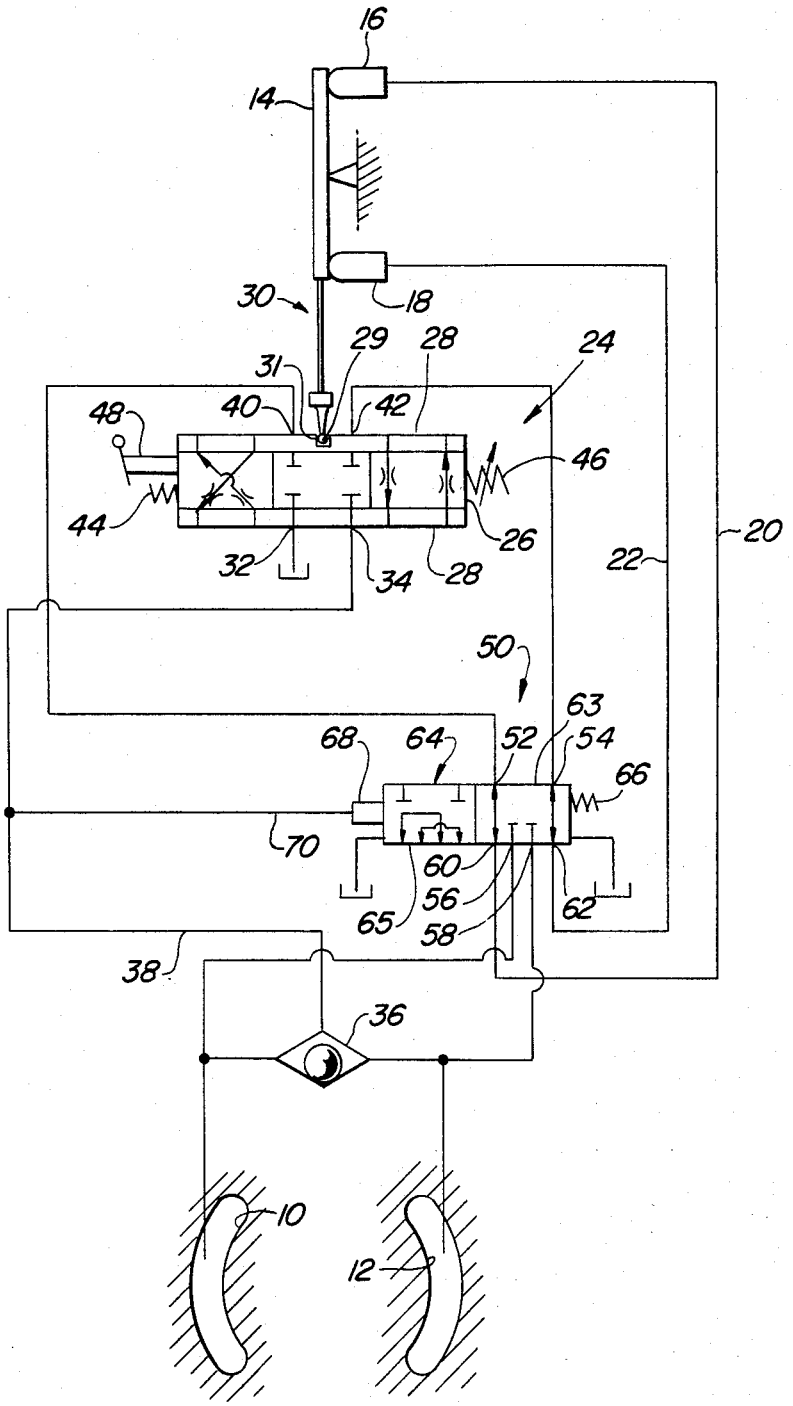
16
14
18
30
29
28
24
31
40
42
48
46
44
26
32
34
28
22
20
50
63
68
64
52
54
66
70
60
56
65
58
62
38
36
10
12

VARIABLE DISPLACEMENT PUMP SYSTEM

BACKGROUND OF THE INVENTION

This invention relates to an override or destroking system for a variable displacement axial piston pump.

In conventional axial piston pumps, destroking is achieved by connecting the swashplate or stroke control pistons to sump or drain. With such a destroking system, the time required to fully destroke the pump may be longer than desired. Another axial piston variable displacement pump has a pressure-responsive stroke control device which is exposed to charge fluid pressure for control and which may be exposed to system pressure for override destroking. However, in this system, the override pressure has to work in opposition to the control pressure, resulting in a somewhat inefficient destroking function.

SUMMARY OF THE INVENTION

An object of the present invention is to provide a variable displacement pump with an efficient and rapid destroking or override system.

Another object of the present invention is to provide a destroking system wherein system pressure is utilized for destroking unopposed by control pressure.

A further object is to limit system pressure with destroking over-center capability.

These and other objects are achieved by the present invention which includes a variable displacement pump with a swashplate controlled by a pair of pistons. A shuttle valve communicates the highest pressure pump workport to an operator-controlled displacement control valve. A pressure-responsive override valve is connected in series between the displacement control valve and the pistons. When an override pressure is achieved, the override valve blocks communication of the control valve with the pair of pistons and communicates the pump workports directly to the pistons for rapid destroking.

BRIEF DESCRIPTION OF THE DRAWING

The sole FIGURE is a schematic view of the present invention shown in connection with portions of a conventional variable displacement pump.

DETAILED DESCRIPTION

A variable displacement pump, such as an axial piston pump in a vehicle hydrostatic drive system, has workports 10 and 12 which may be high or low pressure workports. The position of swashplate 14 is controlled by pressure-operated displacement control pistons 16 and 18 in response to pressure signals in lines 20 and 22.

An operator-controlled stroke or displacement control valve 24 has a spool 26 slidable within a follower sleeve 28. The follower sleeve senses swashplate position by a follower mechanism or linkage 30. The linkage 30 is preferably a pin with a spherical head 29 or cylindrical head (not shown) received in an aperture 31 in the sleeve 28. The valve 24 has a sump inlet 32 and an inlet 34 which receives fluid pressure from the highest pressure workport via ball check or shuttle valve 36 and line 38. The valve 24 also has a pair of control pressure outlets 40 and 42. The spool 26 is spring-centered by fixed and variable springs 44 and 46, respectively, and is operator-controlled via pilot 48.

A pressure compensator override valve 50 is connected in series between the stroke control valve 24 and the pistons 16 and 18. Valve 50 has first and second inlets 52 and 54 communicated with stroke control valve outlets 40 and 42, respectively. Valve 50 also has third and fourth inlets 56 and 58, each communicated with one of the pump workports 10 and 12. Valve outlets 60 and 62 are communicated with pistons 16 and 18 via lines 20 and 22. Valve 50 has a spool 64 movable between a first position 63 wherein inlets 56 and 58 are blocked and wherein inlets 52 and 54 are communicated with outlets 60 and 62, respectively, and a second position 65 wherein inlets 52 and 54 are blocked and wherein inlets 56 and 58 are communicated with outlets 62 and 60, respectively. A spring 66 urges the spool 64 towards its first position. A pressure-responsive pilot 68 is communicated with the higher workport pressure from shuttle valve 36 via lines 70 and 38.

MODE OF OPERATION

Assuming one-directional pump shaft rotation, when the operator shifts spool 26 of stroke control valve 24 from the neutral position shown in the FIGURE, the pressure in pistons 16 and 18 becomes unequal and swashplate 14 will pivot, thus producing fluid flow in and out of workports 10 and 12. The pivoting of swashplate 14 causes a corresponding shifting of sleeve 28 until the original relationship between sleeve 28 and 26 is reattained, whereupon the pressure in pistons 16 and 18 is equalized and the desired tilt of swashplate 14 is maintained until further spool movement via operator input to pilot 48.

The highest pressure from workports 10 or 12 is communicated to pilot 68 via lines 38 and 70. When this selected pressure reaches a certain pressure, then the spool 64 of override valve 50 will move from the illustrated first position to its second position, wherein the pressures at workports 10 and 12 are communicated to the appropriate pistons 16 and 18 to rapidly limit pressure by pivoting the swashplate 14 toward or beyond its neutral position.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A hydraulic system comprising:

a bi-directional variable displacement pump having high and low pressure workports and having first and second pressure-responsive displacement control pistons for controlling the displacement thereof;

an operator-controlled stroke control valve for generating fluid pressure stroke control signals at first and second outputs thereof;

an override valve connected in series between the stroke control valve outputs and the displacement control pistons and movable in response to pump workport pressure from a first position wherein the first and second stroke control valve outlets are communicated to the first and second control pistons, respectively, to a second position wherein communication between the stroke control valve outputs and the first and second control pistons is blocked and wherein the pump workports are communicated to the first and second control pistons to reduce pump displacement; and resilient means biased to urge the override valve to its first position.

2. The invention of claim 1, wherein:

the override valve comprises a pressure-responsive pilot operable to move the override valve against the bias of the resilient member; and the hydraulic system further comprises a shuttle valve for communicating the high pressure workport to the pilot.

3. A hydraulic system comprising:

a variable displacement pump having high and low pressure workports and pressure-responsive displacement control means for controlling the displacement thereof;

an operator-controlled stroke control valve having a pair of outlets, a low pressure inlet connected to a reservoir, a high pressure inlet and a valve member movable to control communication between the inlets and outlets thereby generating fluid pressure stroke control signals at the outlets;

an override valve comprising a housing having first and second inlets communicated with the stroke control valve outlets, third and fourth inlets communicated with the high and low pressure workports and first and second outlets communicated with the displacement control means, a valve spool movable in the housing to a first position wherein the first and second inlets are communicated with the first and second outlets and wherein the third and fourth inlets are blocked, and to a second position wherein the first and second inlets are blocked and wherein the third and fourth inlets are communicated with the first and second outlets, a resilient member biased to urge the spool member towards the second position and a pressure-responsive pilot for moving the spool valve to the first position against the bias of the resilient member; and shuttle valve means for communicating the high pressure workport to the pilot and to the high pressure inlet of the stroke control valve.

4. A hydraulic system comprising:

a variable displacement pump having a pair of workports and a displacement control swashplate operated by a pair of swashplate servo pistons;

an operator-controlled stroke control valve having a pair of control outlets at which are generated fluid pressure stroke control signals; and an override valve comprising a housing having first and second ports communicated with the control outlets of the stroke control valve, third and fourth ports each communicated with a corresponding one of the pump workports, fifth and sixth ports each communicated with a corresponding one of the swashplate servo pistons, a valve spool movable in the housing to a first position wherein the first and second ports are communicated with the fifth and sixth ports, respectively, and wherein the third and fourth ports are blocked and to a second position wherein the first and second ports are blocked and wherein the third and fourth ports are communicated with the fifth and sixth ports, respectively, resilient means biased to urge the spool member towards its first position and pressure-responsive pilot means for moving the valve spool to a second position; and means for communicating fluid pressure from one of the pump workports to the pilot means.

5. The invention of claim 4, wherein the communicating means comprises:

a shuttle valve having a housing which defines a pair of inlets each communicating with one of the pump workports and an outlet communicated with the pilot means and having a ball check movable in the housing to positions wherein the shuttle valve inlet communicated with the highest pressure pump workport is communicated with the shuttle valve outlet.

6. The invention of claim 4, wherein the stroke control valve comprises:

a spring-centered, operator-actuatable spool movable within a follower sleeve, the follower sleeve sensing swashplate position via a position feedback linkage.

7. The invention of claim 6, wherein:

the feedback linkage comprises a pin with a spherical head received in an aperture in the sleeve.

* * * * *